US006802591B2

(12) United States Patent
Takahashi

(10) Patent No.: US 6,802,591 B2
(45) Date of Patent: Oct. 12, 2004

(54) LIQUID JET APPARATUS

(75) Inventor: Tomoaki Takahashi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 54 days.

(21) Appl. No.: 10/361,016

(22) Filed: Feb. 10, 2003

(65) Prior Publication Data

US 2003/0151639 A1 Aug. 14, 2003

(30) Foreign Application Priority Data

| | | |
|---|---|---|
| Feb. 12, 2002 | (JP) | 2002-033950 |
| Mar. 20, 2002 | (JP) | 2002-078420 |
| Nov. 22, 2002 | (JP) | 2002-339282 |
| Nov. 26, 2002 | (JP) | 2002-342208 |
| Dec. 25, 2002 | (JP) | 2002-374964 |

(51) Int. Cl.[7] ..... B41J 2/165
(52) U.S. Cl. ..... 347/36
(58) Field of Search ..... 347/22, 23, 24, 347/29, 30, 31, 34, 35, 36, 44, 50, 104, 112

(56) References Cited

U.S. PATENT DOCUMENTS 5,347,301 A * 9/1994 Kawanishi et al. ..... 347/114
6,014,531 A * 1/2000 Ebata et al. ..... 399/69
6,168,259 B1 * 1/2001 Capurso ..... 347/36

FOREIGN PATENT DOCUMENTS

| | | |
|---|---|---|
| JP | 57-56270 | 4/1982 |
| JP | 10-264412 | 10/1998 |
| JP | 2002-86757 | 3/2002 |

* cited by examiner

*Primary Examiner*—Shih-Wen Hsieh
(74) *Attorney, Agent, or Firm*—Sughrue Mion, PLLC

(57) ABSTRACT

This apparatus has a liquid jet head for ejecting liquid drops from nozzle openings of a nozzle plate, a scanning mechanism for scanning the head in the head scanning direction, a feed mechanism for feeding an object to be processed in the direction perpendicular to the head scanning direction, an absorption member arranged in the area, which is on the rear side of the object during processing and opposite to the head, for absorbing liquid drops ejected in the area outside the object, and a potential difference generation unit for generating a potential difference between at least one of the absorption member and the member neighboring the absorption member and the nozzle plate. According to this apparatus, liquid drops ejected from the head into the area outside the object can be prevented from misting.

54 Claims, 12 Drawing Sheets

$d_2 > d_1$ $d_2 > d_1$

LIQUID JET APPARATUS

BACKGROUND OF THE INVENTION

1. Field of the Invention

The present invention relates to a liquid jet apparatus for ejecting liquid drops from nozzle openings of a liquid jet head to an object to be processed.

2. Description of the Related Art

As a typical example of a conventional liquid jet apparatus, there is an ink jet recording apparatus having an ink jet recording head for recording images. As other liquid jet apparatus, for example, an apparatus having a color material jet head used for manufacturing color filters of liquid crystal displays, an apparatus having an electrode material (conductive paste) jet head used for forming electrodes of organic EL displays and face emission displays (FED), an apparatus having a biological organic substance jet head used for manufacturing biological chips, and an apparatus having a sample jet head as a precise pipette may be cited.

An ink jet recording apparatus as a typical example of the liquid jet apparatus has been recently used in many printings including color printings because printing noise is comparatively low and small dots can be produced highly densely.

Such an ink jet recording apparatus generally has an ink jet recording head loaded on a carriage and moving back and forth in the width direction (head scanning direction) of recording media (an object to be processed) such as recording paper and a feed mechanism for moving recording media in the direction (feed direction) perpendicular to the head scanning direction and further has a platen which is arranged opposite to the recording head, supports recording media to be fed by the feed mechanism from the back side, and positions recording media with respect to the recording head.

The ink jet recording apparatus prints by ejecting ink drops onto recording media by the recording head in correspondence with print data. And, the recording head loaded on the carriage can eject ink in various colors, for example, black, yellow, cyan, and magenta, thus not only text printing can be realized by black ink but also full-color printing can be realized by changing the ejection rate of each ink.

When the overall surface of each recording medium is to be printed free of blanks on the edges of the recording medium (so-called "four-side edge-free printing") by the ink jet recording apparatus, in consideration of an allowance for displacements of the recording medium and the carriage, an area slightly wider than the size of the recording medium is printed.

Namely, the surface is printed free of blanks on the left and right edges (edges in the feed direction) of the recording medium, so that the scanning range of the recording head during printing can be set wider so as to extend beyond the side edges of the recording medium.

Furthermore, when the surface is to be printed free of blanks on the front and rear edges (edges in the head scanning direction) of the recording medium, at the start time of printing the recording medium, up to an area extending beyond the front edge of the recording medium is designated as an area to be printed and also at the end time of printing the recording medium, up to an area extending beyond the rear edge of the recording medium is designated as an area to be printed.

And, ink drops ejected into the areas beyond the recording medium are absorbed by an absorption member (sponge, etc.) arranged on the rear side of the recording medium opposite to the recording head.

As mentioned above, when the surface is to be printed free of blanks on the edges of the recording medium, ink drops are ejected in areas extending front and rear or left and right from the edges of the recording medium, thereby a problem arises that an ink mist moved on the rear side of the recording medium is attached to the rear edge of the recording medium and soils the recording medium. Particularly, there are problems imposed in a case of printing on both sides of recording media and a case of printing recording media both sides of which are to be used such as postal cards. Further, there are problems imposed in that misted ink soils the inside of the apparatus, and an ink mist is attached to the electric circuit and linear scale, thereby causes malfunctions, and an ink mist is deposited on the ink cartridge, and a user's hand may be soiled.

Further, generally, the feed mechanism for feeding a recording medium in the feed direction has rollers arranged opposite to each other so as to hold and feed the recording medium. One of the rollers arranged opposite to each other is a drive roller having a structure that alumina is baked on the surface of a metallic roller so as to improve the frictional force and the other roller is a follower roller made of plastics.

And, generally, by contact and separation of these rollers with a recording medium, rubbing with the next recording medium when recording media are fed from an auto-sheet feeder, or contact of each recording medium with the structure member in the feed path, each recording medium is charged at the point of time when it is fed into the printing area. And, when recording media are charged like this, an ink mist is easily attached to the rear of each recording medium.

In order to solve these problems, a method for installing a discharging unit such as a discharging brush for discharging charged recording media may be considered. In this case, the discharging unit is installed inevitably on the downstream side of the feed mechanism composed of a pair of rollers in the feed direction, thus the distance from the feed mechanism to the printing area is made longer. Therefore, problems of deterioration of the feed precision of recording media and rising of recording media are easily caused. Further, another problem arises that paper powder is generated due to rubbing recording media such as paper by the discharging brush and attached to the nozzle, causing deterioration of the ejection performance of ink drops.

Further, in order to satisfy the recent request of high image quality, the size of ink drops ejected from the recording head is becoming smaller increasingly. Ink drops in a small size slow down suddenly due to the viscosity resistance of air, so that ink drops ejected into an area outside a recording medium from the recording head may be misted without reaching the absorption member.

The present invention has been developed with the foregoing in view and is intended to provide a liquid jet apparatus capable of preventing liquid drops ejected from a liquid jet head into an area outside an object to be processed from misting.

Especially, the present invention is intended to provide, even when liquid drops are to be fed free of blanks on the edges of an object to be processed, a liquid jet apparatus capable of preventing a liquid mist from attaching to the rear edge of the object to be processed.

SUMMARY OF THE INVENTION

A liquid jet apparatus according to the first aspect of the present invention comprises: a liquid jet head having a nozzle plate with a nozzle opening, said liquid jet head being configured to eject liquid drops from said nozzle opening by changing pressure of liquid in a pressure chamber interconnecting to said nozzle opening, a scanning mechanism configured to scan said liquid jet head in a head scanning direction, a feed mechanism configured to feed an object to be processed, to which liquid drops ejected from said liquid jet head are applied, in a feed direction perpendicular to said head scanning direction, an absorption member arranged in an area, which is on a rear side of said object to be processed under processing and opposite to said liquid jet head, and configured to absorb liquid drops ejected into an area outside said object to be processed, and a potential difference generation unit configured to generate a potential difference between at least one of said absorption member and a member neighboring said absorption member and said nozzle plate.

Preferably, said potential difference generation unit applies a voltage to at least one of said absorption member and said member neighboring said absorption member and grounds said nozzle plate.

Preferably, said potential difference generation unit grounds at least one of said absorption member and said member neighboring said absorption member and applies a voltage to said nozzle plate.

Preferably, said member neighboring said absorption member has a conductive part extended in said head scanning direction and a conductive part extended in said feed direction.

Preferably, said member neighboring said absorption member is formed in a lattice shape.

Preferably, said absorption member includes a conductive material.

Preferably, said absorption member is formed by mixing a conductive material in polyethylene or polyurethane and foaming the same.

Preferably, said absorption member is formed by plating a foam material of polyethylene or polyurethane with a conductive material.

Preferably, said absorption member contains an electrolytic liquid.

Preferably, said electrolytic liquid is a liquid ejected from said liquid jet head.

Preferably, the liquid jet apparatus further comprises a holding unit configured to hold said object to be processed under processing in an electrically isolated state.

Preferably, said holding unit has an insulating material installed at least on a surface of each member making contact with said object to be processed under processing.

Preferably, the liquid jet apparatus further comprises: a platen arranged opposite to said liquid jet head so as to support said object to be processed, which is fed by said feed mechanism, from a rear of said article and position said object to be processed with respect to said liquid jet head, wherein said absorption member is installed in said platen.

According to the liquid jet apparatus by the first aspect of the present invention, a potential difference is generated between at least one of an absorption member and a member neighboring to the absorption member and a nozzle plate by a potential difference generation unit, thus Coulomb force is acted on charged liquid drops ejected from a nozzle opening toward the absorption member, so that liquid drops ejected from the liquid jet head into an area outside an object to be processed can be surely prevented from misting.

A liquid jet apparatus according to the second aspect of the present invention comprises: a liquid jet head configured to eject liquid drops from a nozzle opening by changing pressure of liquid in a pressure chamber interconnecting to said nozzle opening, a scanning mechanism configured to scan said liquid jet head in a head scanning direction, a feed mechanism configured to feed an object to be processed, to which liquid drops ejected from said liquid jet head are given, in a feed direction perpendicular to said head scanning direction, and a liquid drop acquisition electrode arranged in an area, which is on a rear side of said object to be processed under processing and opposite to said liquid jet head, and configured to acquire liquid drops ejected into an area outside an edge of said object to be processed by electrostatic force.

Preferably, a liquid jet apparatus further comprises: a platen arranged opposite to said liquid jet head so as to support said object to be processed, which is fed by said feed mechanism, from a rear of said article and position said object to be processed with respect to said liquid jet head, said platen having an absorption member configured to absorb liquid drops ejected from said liquid jet head, wherein said liquid drop acquisition electrode is arranged in a neighborhood of said absorption member.

Preferably, said liquid drop acquisition electrode has a part extended in said head scanning direction and a part extended in said feed direction.

Preferably, said liquid drop acquisition electrode is composed of a metallic wire member.

Preferably, said liquid drop acquisition electrode is composed of a long and narrow metallic member having a triangular section.

Preferably, said liquid drop acquisition electrode is composed of a metallic needle member.

Preferably, a surface of said liquid drop acquisition electrode is treated with an insulation.

Preferably, a surface of said liquid drop acquisition electrode is treated with a corrosion preventive.

Preferably, the liquid jet apparatus according to claim 14, further comprises: a platen arranged opposite to said liquid jet head so as to support said object to be processed, which is fed by said feed mechanism, from a rear of said article and position said object to be processed with respect to said liquid jet head, said platen having an absorption member configured to absorb liquid drops ejected from said liquid jet head, wherein said absorption member is said liquid drop acquisition electrode.

Preferably, the liquid jet apparatus further comprises: a charging unit configured to charge said object to be processed.

Preferably, said charging unit has a corona discharger or a charging brush.

Preferably, said feed mechanism has a roller configured to feed said object to be processed onto said platen, and wherein said charging unit has a roller cleaner for cleaning a surface of said roller.

Preferably, the liquid jet apparatus further comprises: a voltage application unit configured to apply a high voltage to said object to be processed and hold said object to be processed at a high potential.

Preferably, said liquid drop acquisition electrode is grounded.

Preferably, the liquid jet apparatus further comprises: a voltage application unit configured to apply a high voltage to said liquid drop acquisition electrode and hold said liquid drop acquisition electrode at a high potential.

Preferably, the liquid jet apparatus further comprises a discharging unit configured to discharge static electricity from said object to be processed and installed on a downstream side of said liquid jet head in said feed direction.

Preferably, said discharging unit has a discharging brush.

Preferably, said discharging brush is in contact with a rear of said object to be processed.

According to the liquid jet apparatus by the second aspect of the present invention, liquid drops ejected into an area outside the edges of an object to be processed can be attracted and acquired by a liquid drop acquisition electrode, so that even when liquid drops are to be fed without leaving blanks on the edges of the object to be processed, a liquid mist can be prevented from attaching to the rear edge of the object to be processed.

A liquid jet apparatus according to the third aspect of the present invention comprises: a liquid jet head configured to eject liquid drops from a nozzle opening by changing pressure of liquid in a pressure chamber interconnecting to said nozzle opening, a scanning mechanism configured to scan said liquid jet head in a head scanning direction, a feed mechanism configured to feed an object to be processed, to which liquid drops ejected from said liquid jet head are given, in a feed direction perpendicular to said head scanning direction, a static electricity charging member arranged in an area which is on a rear side of said object to be processed under processing and opposite to said liquid jet head, and a static electricity generation member configured to generate static electricity by dynamically making contact with said static electricity charging member.

Preferably, the liquid jet apparatus further comprises: a platen arranged opposite to said liquid jet head so as to support said object to be processed, which is fed by said feed mechanism, from a rear of said article and position said object to be processed with respect to said liquid jet head, said platen having an absorption member configured to absorb liquid drops ejected from said liquid jet head, wherein at least a part of said static electricity charging member is arranged in the neighborhood of said absorption member.

Preferably, said platen has a liquid exhaust port.

Preferably, said platen has a liquid exhaust groove.

Preferably, said static electricity charging member is formed in a tubular shape, and wherein said static electricity generation member is arranged inside said static electricity charging member and driven and rotated around a revolving axis parallel with a tubular axis of the static electricity charging member.

Preferably, said static electricity generation member has a rotatable brush configured to dynamically make contact with an inner peripheral surface of said tubular static electricity charging member, and wherein said brush has a sectional shape of a central angle of less than or equal to 180° around said revolving axis.

Preferably, said brush is positioned and stopped on a far side from said liquid jet head during a liquid jetting operation and is rotated when said liquid jetting operation is not performed.

Preferably, said static electricity charging member is formed by a sheet-like member curved convexly toward said liquid jet head, and wherein said static electricity generation member is arranged on a rear side of said static electricity charging member viewed from a position of said liquid jet head.

Preferably, said static electricity generation member has a rotatable brush configured to dynamically make contact by rotation with a rear of said static electricity charging member composed of said sheet-like member, and wherein said brush has a sectional shape of a central angle of less than or equal to 180° around said revolving axis.

Preferably, said brush is positioned on a far side from said liquid jet head during a liquid jetting operation and stopped in a non-contact state with said static electricity charging member and is rotated when said liquid jetting operation is not performed.

Preferably, said static electricity charging member is formed by a sheet-like member, wherein said absorption member is arranged on a liquid jet head side of said static electricity charging member, and said static electricity generation member is arranged on a rear side of said static electricity charging member viewed from said liquid jet head.

Preferably, said static electricity generation member has a rotatable brush configured to dynamically make contact by rotation with a rear of said static electricity charging member composed of said sheet-like member, and wherein said brush has a sectional shape of a central angle of less than or equal to 180° around-said revolving axis.

Preferably, said brush is positioned on a far side from said liquid jet head during a liquid jetting operation and stopped in a non-contact state with said static electricity charging member, and said brush is rotated when said liquid jetting operation is not performed.

Preferably, said static electricity generation member is positioned and stopped on a far side from said liquid jet head during a liquid jetting operation, and said static electricity generation member dynamically makes contact with said static electricity charging member when said liquid jetting operation is not performed.

Preferably, during said liquid jetting operation, said static electricity generation member is in a non-contact state with said static electricity charging member.

Preferably, during said liquid jetting operation, a distance from said static electricity charging member to said static electricity generation member is longer than a distance from said static electricity charging member to a nozzle forming surface of said liquid jet head.

Preferably, said static electricity charging member and said static electricity generation member are extended in said head scanning direction.

Preferably, said static electricity charging member has a plastic sheet.

Preferably, said static electricity generation member has a brush.

Preferably, said static electricity generation member is driven by power of said feed mechanism.

Preferably, said liquid jet head has a nozzle plate in which said nozzle opening is formed and said nozzle plate is electrically grounded.

According to the liquid jet apparatus by the third aspect of the present invention, liquid drops ejected into an area outside the edges of an object to be processed can be attracted and acquired by using static electricity charged on a static electricity charged member, so that even when liquid drops are to be fed without leaving blanks on the edges of the object to be processed, a liquid mist can be prevented from attaching to the rear edge of the object to be processed and to the inside of the apparatus.

BRIEF DESCRIPTION OF THE DRAWINGS

The present invention will be understood more fully from the detailed description given hereunder and from the accompanying drawings of the preferred embodiments of the invention. However, the drawings are not intended to imply limitations of the invention to be a specific embodiment, but are for explanations and understandings only.

In the drawings.

DESCRIPTION OF THE PREFERRED EMBODIMENTS

An ink jet recording apparatus as an embodiment of the liquid jet apparatus by the first aspect of the present invention will be explained hereunder with reference to the accompanying drawings.

The ink jet recording apparatus of this embodiment has an ink jet recording head (a kind of liquid jet head) configured to eject ink drops from nozzle openings by causing pressure changes in ink in pressure chambers by pressure generation elements installed in correspondence with the pressure chambers interconnecting to the nozzle openings, respectively. As a pressure generation element, for example, a piezo-electric vibrator may be used.

Figure 1:
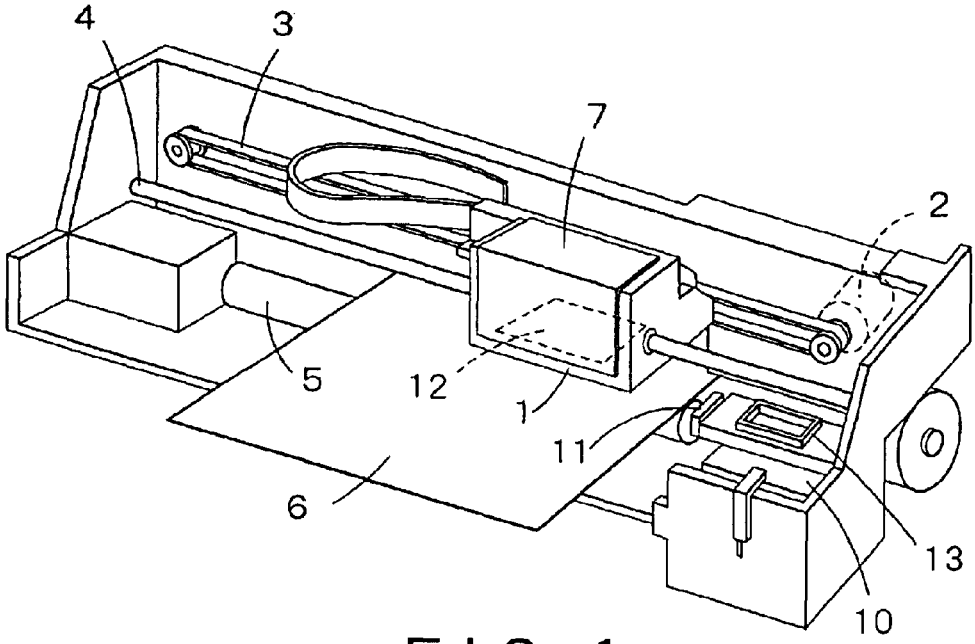
FIG. 1 is a perspective view showing a schematic constitution of an ink jet recording apparatus as an embodiment of the liquid jet apparatus of the present invention.

In FIG. 1, numeral 1 indicates a carriage, and the carriage 1 is structured so as to be guided along a guide member 4 via a timing belt 3 driven by a carriage motor 2 and move back and force in the axial direction of a platen 5. The platen 5 supports recording paper 6 (a kind of object to be processed) from the rear thereof and positions the recording paper 6 with respect to a recording head 12.

The carriage 1, carriage motor 2, timing belt 3, and guide member 4 constitute the scanning mechanism for letting the ink jet recording head 12 scan in the head scanning direction together with the carriage 1.

The ink jet recording head 12 has a plurality of pressure chambers 12*b* interconnecting respectively to a plurality of nozzle openings and is loaded on the side of the carriage 1 opposite to the recording paper 6. Further, on the carriage 1, an ink cartridge 7 for feeding ink to the recording head 12 is mounted in a removable state.

In the home position (the right side of FIG. 1) which is a non-printing area of the ink jet recording apparatus, a cap member 13 is arranged and the cap member 13 is structured, when the recording head 12 loaded on the carriage 1 moves to the home position, so as to be pressed against the nozzle forming surface of the recording head 12 and form a closed space between itself and the nozzle forming surface. And, under the cap member 13, a pump unit 10 for giving negative pressure to the closed space formed by the cap member 13 is arranged.

In the neighborhood of the cap member 13 on the printing area side, a wiping unit 11 having an elastic plate such as rubber is arranged so as to move back and forth, for example, in the horizontal direction to the moving track of the recording head 12 and structured so as to wipe out the nozzle forming surface of the recording head 12 as required when the carriage 1 moves back and forth on the side of the cap member 13.

Figure 3:
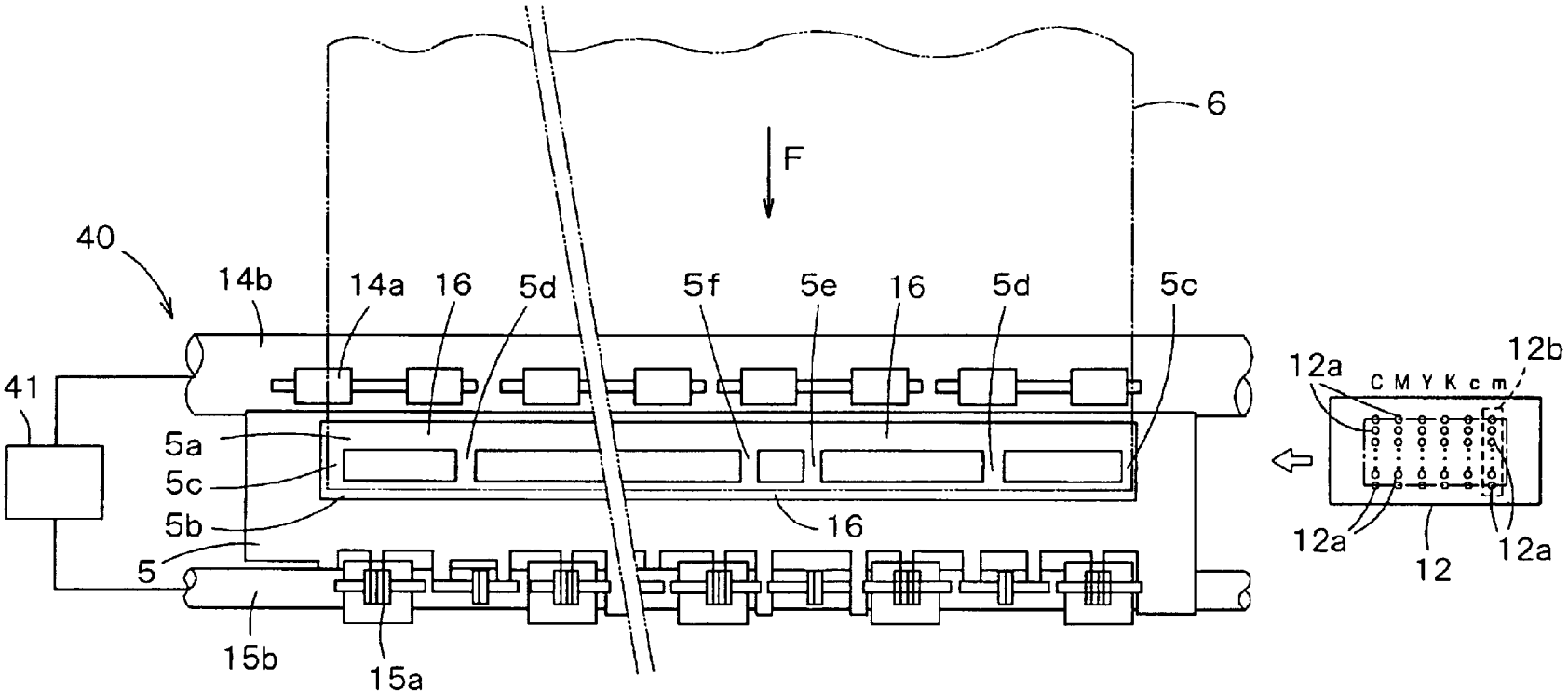
FIG. 3 is a drawing showing the enlarged platen and its circumference of the ink jet recording apparatus shown in FIGS. 1 and 2.

As shown in FIG. 3, the ink jet recording apparatus of this embodiment further has a feed mechanism 40 for intermittently feeding the recording paper 6 to be printed by the recording head 12 in the direction perpendicular to the head scanning direction. The feed mechanism 40 is driven by a paper feed motor 41.

The feed mechanism 40 has paper feed rollers 14*a* and 14*b* arranged opposite to each other so as to hold and feed the recording paper 6 onto the platen 5 and paper ejection rollers 15*a* and 15*b* arranged opposite to each other so as to eject the printed recording paper 6. The paper feed rollers 14*a* and paper ejection rollers 15*a* are follower rollers and the paper feed roller 14*b* and paper ejection roller 15*b* are drive rollers. The paper feed roller 14*b* and paper ejection roller 15*b* which are drive rollers are rotated by the drive force from the paper feed motor 41.

As shown in FIG. 3, in the platen 5, a plurality of ink receiving longitudinal openings 5*c*, 5*d*, 5*e*, and 5*f* extending in the direction parallel to the paper feed direction (feed direction) F and a plurality of ink receiving transverse openings 5*a* and 5*b* extending in the head scanning direction perpendicular to the paper feed direction F are formed.

Among the plurality of ink receiving longitudinal openings 5*c*, 5*d*, 5*e*, and 5*f*, a pair of ink receiving openings 5*c* are arranged so that the left and right ends of the recording paper 6 of A3 size respectively pass right above them, and a pair of ink receiving openings 5*d* are arranged so that the left and right ends of the recording paper 6 of B4 size respectively pass right above them, and a pair of ink receiving openings 5*e* are arranged so that the left and right ends of the recording paper 6 of A4 size respectively pass right above them, and a pair of ink receiving openings 5*f* are arranged so that the left and right ends of the recording paper 6 of B5 size respectively pass right above them.

Further, the plurality of ink receiving transverse openings 5*a* and 5*b* are composed of paper feed side ink receiving openings 5*a* arranged on the paper feed side and paper ejection side ink receiving openings 5*b* arranged on the paper ejection side.

In these ink receiving openings 5*a*, 5*b*, 5*c*, 5*d*, 5*e*, and 5*f*, absorption members 16 are respectively arranged so as to absorb ink ejected from the recording head 12.

In this embodiment, the absorption members 16, are formed by mixing a conductive material such as carbon in polyethylene or polyurethane and foaming the same. Or, the absorption members 16 may be formed by plating a foam material of polyethylene or polyurethane with a conductive material.

Further, the absorption members 16 may be made conductive by containing an electrolytic water solution such as NaCl or KC1 or water. Even when only water is contained, it takes in $CO_2$ in the atmosphere and a conductive electrolytic solution is obtained.

As a simpler method, ink itself may be used as an electrolyte. In this case, before execution of the first no-edge printing, in a state of no recording paper 6 provided, it is possible to slowly scan the carriage 1 so as to prevent ink drops from misting, eject ink drops onto the absorption members 16 from the recording head 12 so as to contain ink, and make them conductive.

Figure 4:
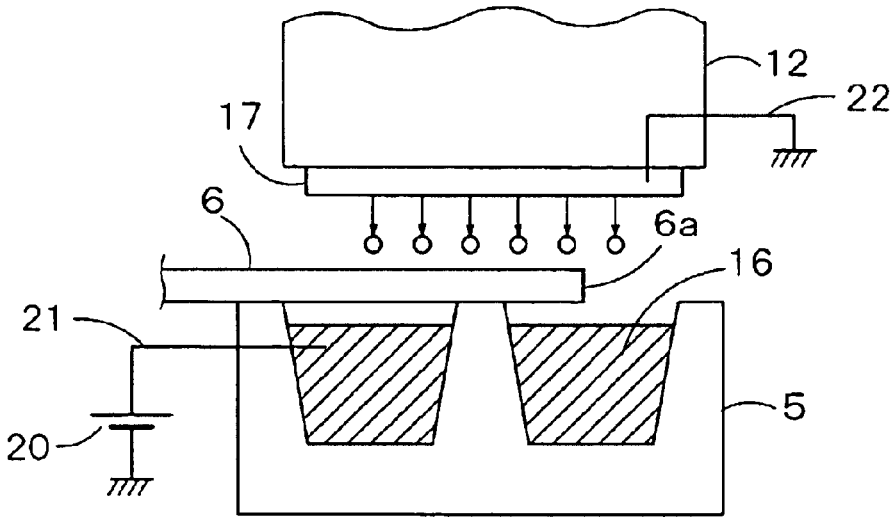
FIG. 4 is a sectional view showing the enlarged potential difference generation unit and its circumference of the ink jet recording apparatus according to the first aspect of the present invention shown in FIGS. 1 and 2.

And, the ink jet recording apparatus of this embodiment, as shown in FIG. 4, has a power source 20 for applying a positive voltage to the conductive absorption members 16, wires 21 thereof, and a wire 22 for grounding a nozzle plate 17. The power source 20 and wires 21 and 22 constitute a potential difference generation unit for generating a potential difference between the nozzle plate 17 and the absorption members 16.

Figure 5:
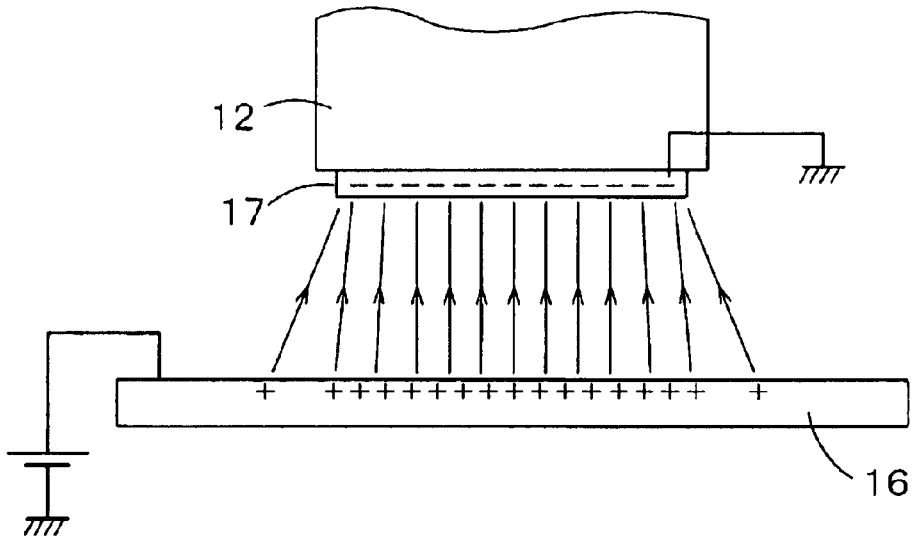
FIG. 5 is a drawing showing the situation of lines of electric force generated by the potential difference generation unit of the ink jet recording apparatus shown in FIGS. 1 and 2.
Figure 6:
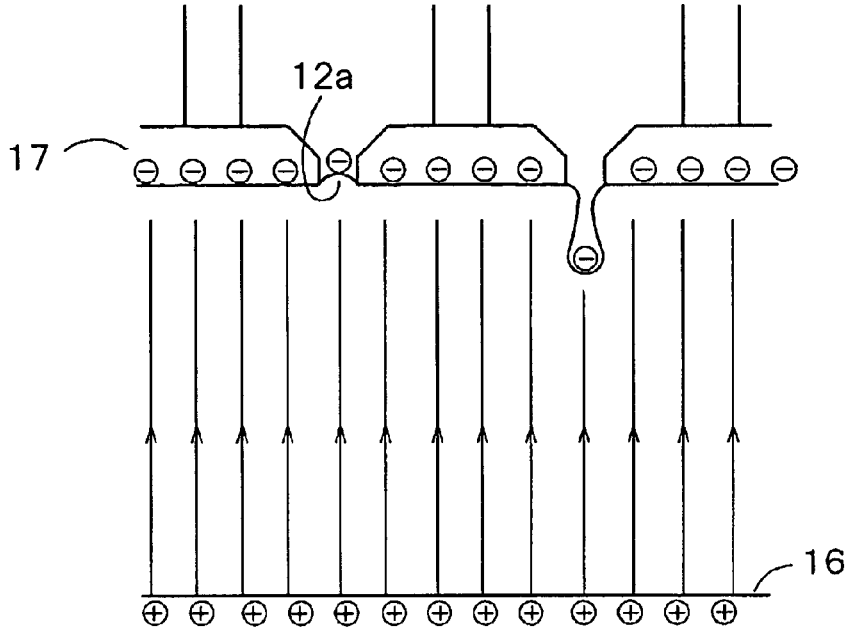
FIG. 6 is a drawing showing an enlarged part of FIG. 5.

The potential difference generating unit applies a positive voltage to the absorption members 16 and grounds the nozzle plate 17, thus, as shown in FIGS. 5 and 6, a positive charge is induced in the absorption members 16 and a negative charge is induced in the nozzle plate 17 at the same time. By doing this, as indicated by arrows in FIGS. 5 and 6, lines of electric force directed toward the nozzle plate 17 from the absorption members 16 are generated.

Further, by inducement of a negative charge in the nozzle plate 17, a negative charge is also induced in the ink meniscus of the nozzle openings 12*a*. The charge a mount can be calculated simply by using the formula of a parallel-plate condenser. Ink drops are ejected from the nozzle openings 12*a* having a negative charge of surface integration of the nozzle openings 12*a* and applied with Coulomb force toward the absorption members 16 by the electric field generated between the nozzle plate 17 and the absorption members 16.

Since ink drops ejected from the nozzle openings 12*a* are applied with the Coulomb force toward the absorption members 16 as mentioned above, even when small sized ink drops are ejected into the area outside the edge 6*a* of the recording paper 6, the ink drops can surely reach the absorption members 16. By doing this, ink drops ejected into the area outside the recording paper 6 can be surely prevented from misting. Therefore, even when printing is to be executed free of a blank on the edge 6*a* of the recording paper 6, attaching of an ink mist to the rear edge of the recording paper 6 and soil inside the apparatus due to an ink mist can be prevented.

Further, when the resistance of the recording paper 6 is reduced due to moisture, and the recording paper 6 is made conductive, and one end of the recording paper 6 is grounded, an electric field is generated between the absorption members 16 with a voltage applied and the recording paper 6 and no electric field is generated between the recording paper 6 and the nozzle plate 17. Therefore, no sufficient charges are induced in the nozzle plate 17 and ink drops and sufficient misting prevention results cannot be obtained by the potential difference generation unit.

Figure 7:
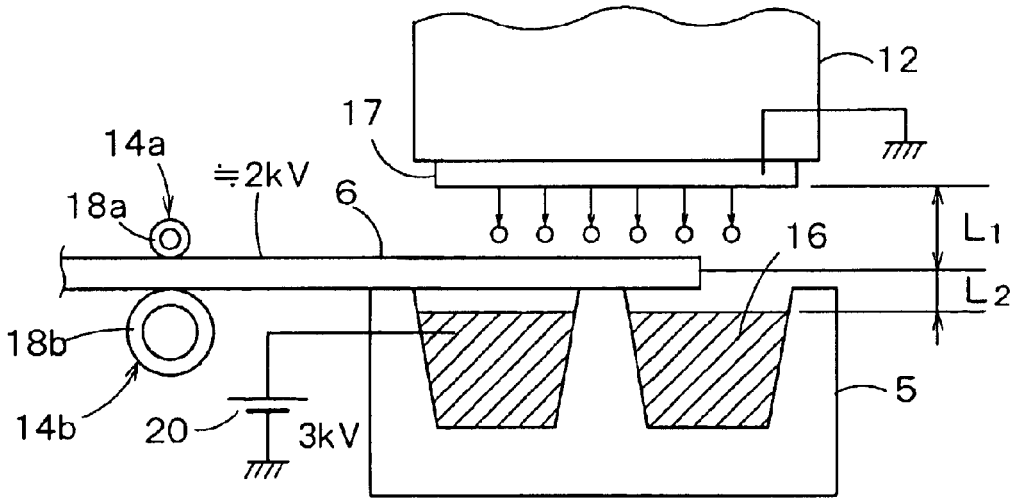
FIG. 7 is a sectional view showing a variation of the embodiment shown in FIG. 4.

Therefore, as a variation of the aforementioned embodiment, it is preferable to install a holding unit for holding the recording paper 6 under processing in an electrically isolated state. The holding unit preferably has, as shown in FIG. 7, insulating materials 18*a* and 18*b* installed on making contact with the recording paper 6 under processing, for example, at least on the surfaces of the paper feed rollers 14*a* and 14*b*.

Since the recording paper 6 under processing is held in the electrically isolated state by the holding unit 18*a* and 18*b* like this, the recording paper 6 acts simply as a dielectric. Here, as shown in FIG. 7, when the distance between the nozzle plate 17 and the recording paper 6 is assumed as L1, and the distance between the recording paper 6 and the surface of the absorption members 16 is assumed as L2, and a voltage of 3 kV is applied to the power source 20, for example, when L1=2.0 mm and L2=1.0 mm, the potential of the recording paper 6 becomes about 2 kV. Therefore, regardless of existence of the recording paper 6, sufficient charges can be induced in the nozzle plate 17 and ink drops.

Figure 8:
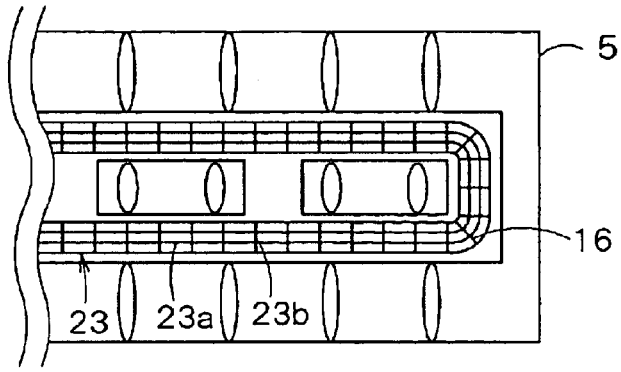
FIG. 8 is a plan view showing another variation of the embodiment shown in FIG. 4.
Figure 9:
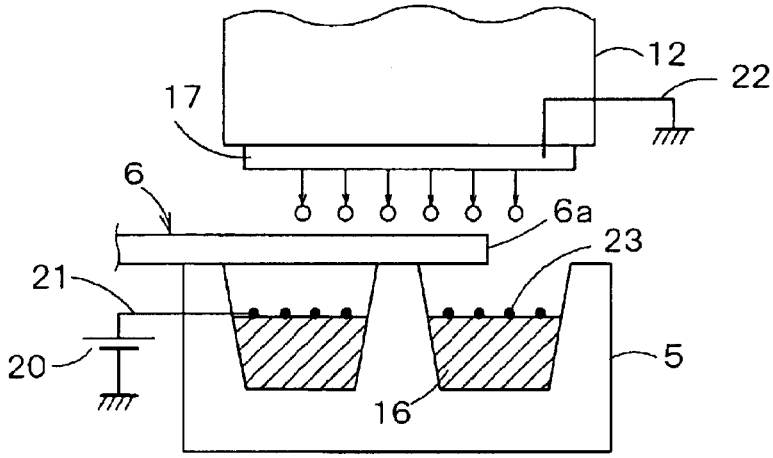
FIG. 9 is a sectional view showing the variation shown in FIG. 8.

Further, as another variation of the aforementioned embodiment, as shown in FIGS. 8 and 9, lattice members 23 composed of a conductive material are arranged side by side on the tops of the absorption members 16 and the power source 20 can apply a positive voltage to the lattice members 23 from the power source 20. The lattice members 23 have conductive parts 23*a* installed in the head scanning direction and conductive parts 23*b* installed in the feed direction.

In this embodiment, there is no need always to make the absorption members 16 conductive and for example, the absorption members 16 can be formed by sponge and the like. Or, in the same way as with the embodiment shown in FIG. 4, the absorption members 16 are made of a conductive material and voltages can be applied to both the lattice members 23 and absorption members 16.

In this embodiment, an ink mist pulled in the lattice members is attached to the surface of the lattice members 23 and flows and drops on the absorption members 16 or directly attached onto the absorption members 16.

Figure 10:
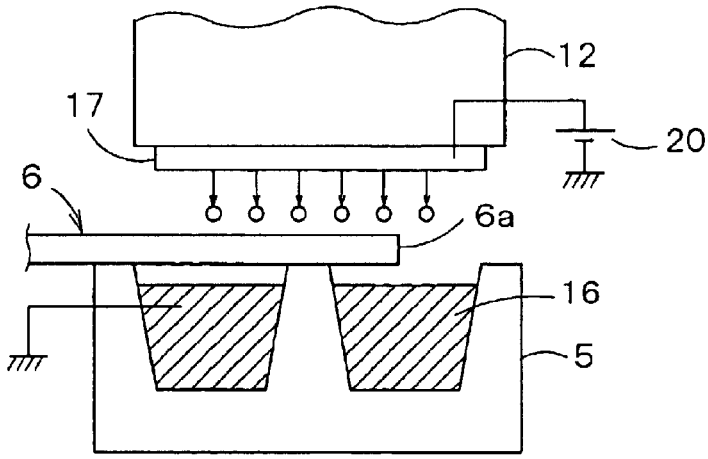
FIG. 10 is a sectional view showing another variation of the embodiment shown in FIG. 4.

Further, as another embodiment of the aforementioned embodiment, the direction of the electric field generated by the potential difference generation unit can be reversed. Namely, as shown in FIG. 10, the absorption members 16 are grounded instead of the nozzle plate 17 and a positive voltage may be applied to the nozzle plate 17 by the power source 20 at the same time. Or, the nozzle plate 17 is grounded and a negative voltage may be applied to the absorption members 16.

Next, an ink jet recording apparatus as an embodiment of the liquid jet apparatus by the second aspect of the present invention will be explained with reference to the accompanying drawings.

Figure 2:
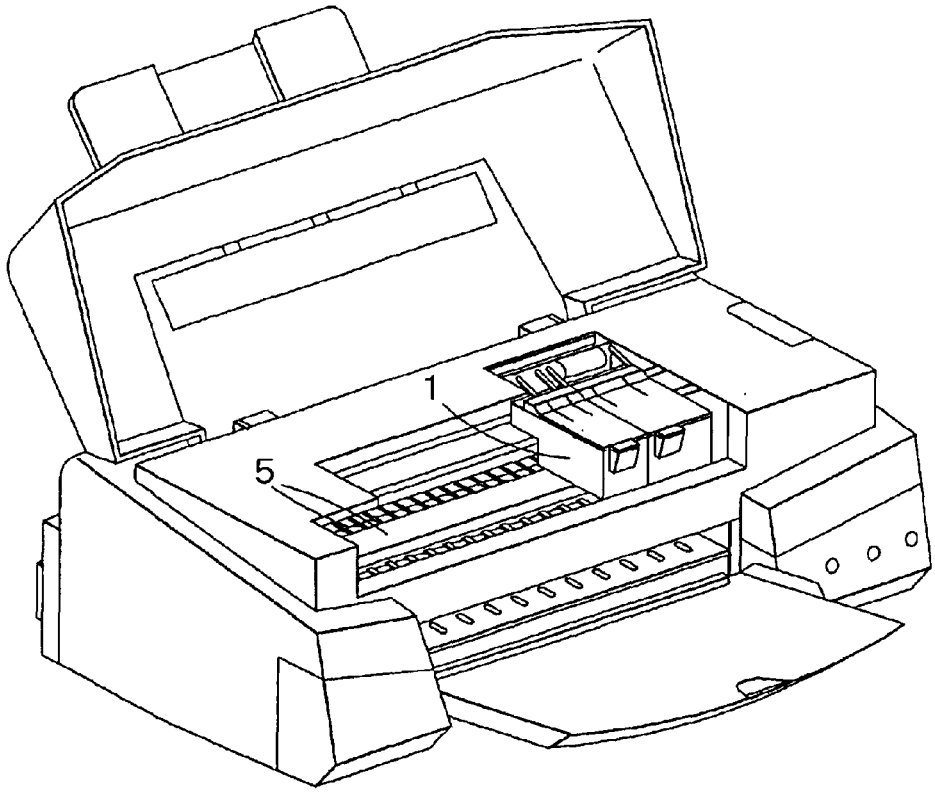
FIG. 2 is another perspective view showing a schematic constitution of an ink jet recording apparatus as an embodiment of the liquid jet apparatus of the present invention.

The ink jet recording apparatus of this embodiment is common in the schematic constitution to the embodiment described in FIGS. 1 to 3, so that the parts intrinsic to this embodiment will be explained hereunder. Further, in this embodiment, the absorption members 16 (FIG. 3) can be formed by sponge and the like.

Next, the ink acquisition electrode of the ink jet recording apparatus of this embodiment will be explained by referring to FIGS. 11 to 13.

Figure 11:
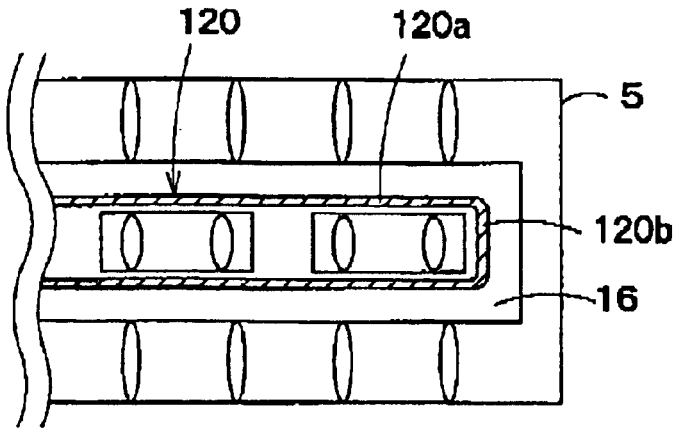
FIG. 11 is a plan view showing the enlarged ink acquisition electrode and its circumference of an ink jet recording apparatus as an embodiment of the liquid jet apparatus by the second aspect of the present invention.
Figure 12:
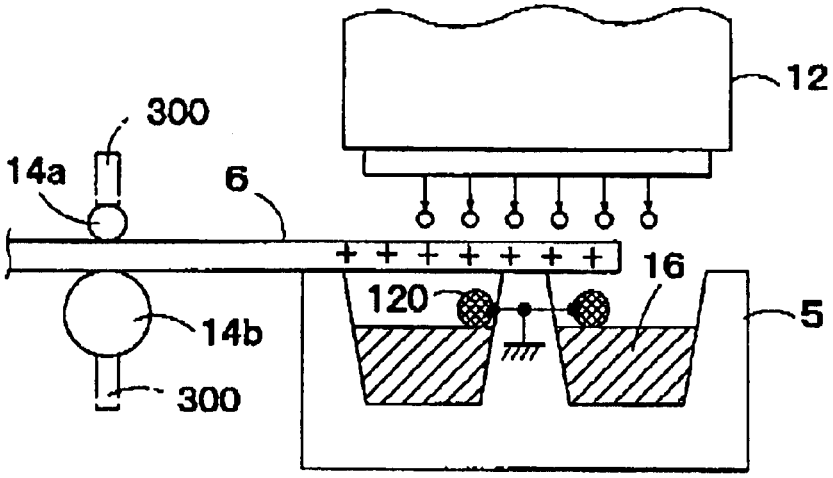
FIG. 12 is a sectional view showing the enlarged ink acquisition electrode and its circumference of an ink jet recording apparatus as an embodiment of the liquid jet apparatus by the second aspect of the present invention.
Figure 13:
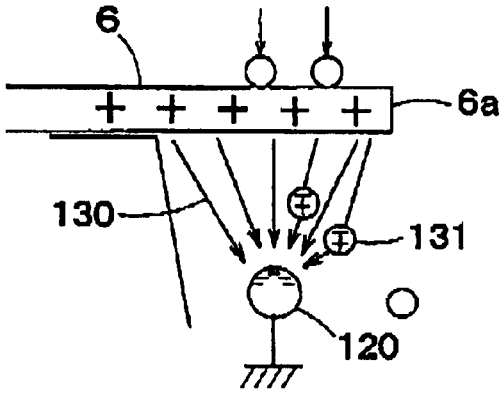
FIG. 13 is a drawing for explaining the action of the ink acquisition electrode shown in FIGS. 11 and 12.

An ink acquisition electrode 120 shown in FIGS. 11 to 13 is formed by a metallic wire and arranged in the area opposite to the recording head 12 so as to be positioned on the rear side of the recording paper 6 during printing. More concretely, the ink acquisition electrode 120 is loaded on the top of the absorption members 16 of the platen 5. As shown in FIG. 11, the ink acquisition electrode 120 has a transverse part 120*a* extending in the head scanning direction and a longitudinal part 120*b* extending in the feed direction. The transverse part 120*a* and longitudinal part 120*b* are continuously formed, so that the ink acquisition electrode 120 is formed in a ring shape.

As shown in FIG. 12, the ink acquisition electrode 120 is grounded. Further, the surface of the ink acquisition electrode 120 is treated with an insulation. Furthermore, the surface of the ink acquisition electrode 120 is treated with a corrosion preventive.

As shown in FIG. 13, the ink acquisition electrode 120 acquires ink drops 131 ejected into the area outside the edge 6*a* of the recording paper 6 by the electrostatic force. Namely, as described already, generally, the recording paper 6 sent into the printing area is charged by contact and/or separation from the paper feed rollers 14*a* and 14*b*, so that between the ink acquisition electrode 120 composed of a metallic wire positioned on the rear side of the recording paper 6 and the charged recording paper 6, there exist lines of electric force as indicated by numeral 130 shown in FIG. 13. As shown in FIG. 13, since there exist the lines of electric force 130 whose density is increased toward the ink acquisition electrode 120, the ink drops 131 with dielectric polarization generated are pulled toward the ink acquisition electrode 120.

And, the ink drops 131 pulled on the side of the ink acquisition electrode 120 are attached to the surface of the ink acquisition electrode 120 and flow and drop on the absorption members 16 or are directly attached onto the absorption members 16.

As mentioned above, according to this embodiment, ink drops ejected into the area outside the edge 6*a* of the recording paper 6 are pulled by the ink acquisition electrode 120 and acquired by the absorption members 16, so that even in printing free of a blank on the edge of the recording paper 6, an ink mist can be prevented from attaching to the rear edge of the recording paper 6.

Further, the insulation process and corrosion preventive process are performed beforehand for the surface of the ink acquisition electrode 120, so that electrolysis by ink and damage of the ink acquisition electrode 120 due to corrosion generation can be prevented.

Figure 14:
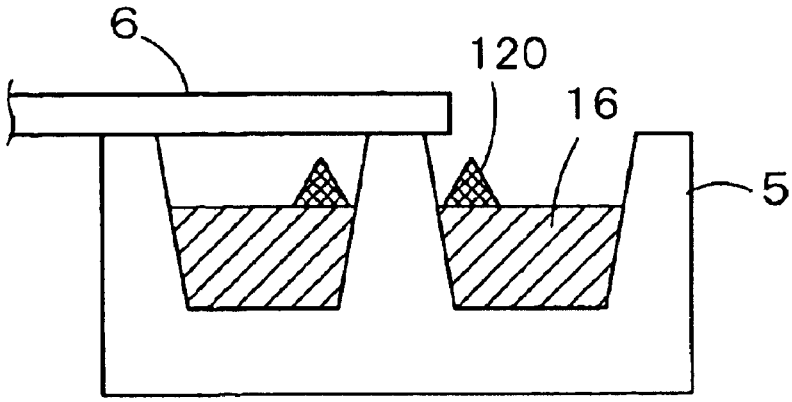
FIG. 14 is a sectional view showing a variation of the ink acquisition electrode shown in FIGS. 11 and 12.

As a variation of the aforementioned embodiment, as shown in FIG. 14, the ink acquisition electrode 120 can be formed by a metallic long and narrow member (a metallic frame) having a triangular section. In this case, the ink acquisition electrode 120 is arranged so as to position one apex of the triangle on the rear side of the recording paper 6. Generally, as the tip of the electrode becomes sharper, the electric field is centralized, so that when the ink acquisition electrode 120 is formed by a metallic long and narrow member having a triangular section like this embodiment, the ink drops 131 can be acquired more surely.

Figure 15:
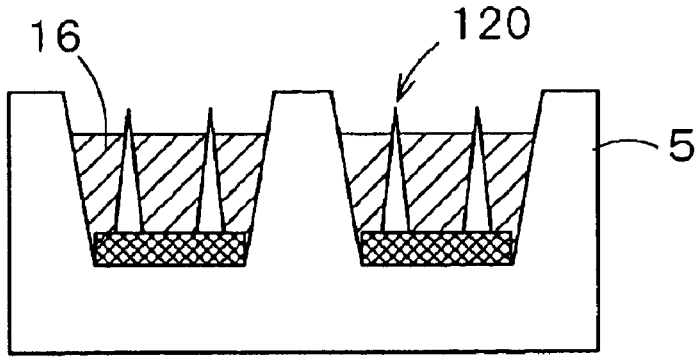
FIG. 15 is a sectional view showing another variation of the ink acquisition electrode shown in FIGS. 11 and 12.

Further, as another variation, as shown in FIG. 15, the ink acquisition electrode 120 may be composed of a plurality of metallic needle members. The base end of each metallic needle member is embedded in each of the absorption members 16 and the forward end thereof is protruded upward from the top of the absorption member 16. Further, the plurality of metallic needle members are arranged in correspondence with the position of the ink acquisition electrode 120 composed of the extending wire member shown in FIG. 11. According to this variation, the ink acquisition electrode 120 has a plurality of sharp tips, so that an ink mist can be acquired more surely.

Figure 16:
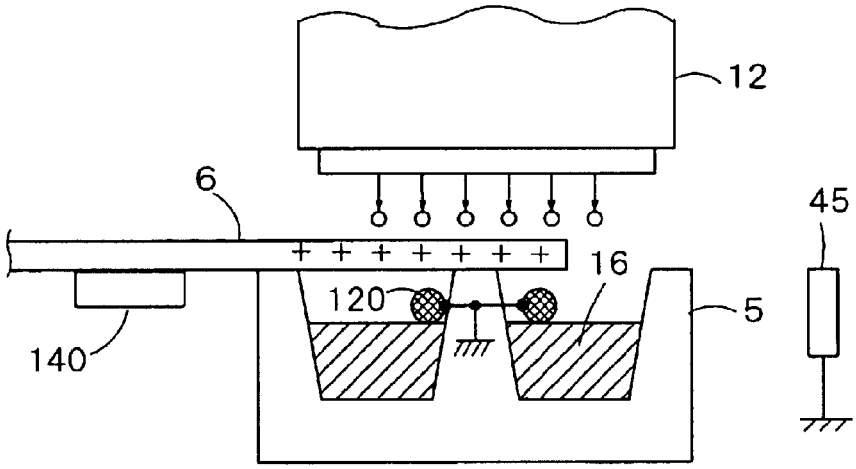
FIG. 16 is a sectional view showing a variation of the embodiment shown in FIGS. 11 and 12.

Further, as still another variation, as shown in FIG. 16, before sending the recording paper 6 into the printing area, a charging unit 140 for positively charging the recording paper 6 can be additionally installed. As the charging unit 140, a corona discharger or a charging brush composed of acrylic fiber or PVC fiber may be used. Or, as a charging unit, as shown in FIG. 12 by an imaginary line, roller cleaners 300 for cleaning the surfaces of the paper feed rollers 14*a* and 14*b* shown in FIG. 3 is installed, thus separation charging between the paper feed rollers 14*a* and 14*b* and the recording paper 6 can be promoted.

By positively charging the recording paper 6 by the charging unit 140 like this, the acquisition effect of the ink drops 131 explained using FIG. 13 can be increased.

Further, when a charging brush is to be used as a charging unit 140, as shown in FIG. 16, the charging brush 140 can be arranged on the upstream side of the paper feed rollers 14*a* and 14*b* in the paper feed direction F (refer to FIG. 3), so that by installation of the charging brush, the distance from the paper feed rollers 14*a* and 14*b* to the printing area will not be made longer. Further, even when paper powder is generated by rubbing the recording paper 6 by the charging brush, paper powder is adsorbed to the recording paper 6 by the electrostatic force of the charged recording paper 6, so that scattered paper powder will not be attached to the nozzle opening.

Further, as shown in FIG. 16, a discharging brush 145 may be arranged on the downstream side of the printing area so as to make contact with the rear of the recording paper 6. By the discharging brush 145, the recording paper after ending of printing can be discharged surely. Immediately after printing, ink may not be dried and in order to prevent the print surface from ink soil, it is desirable to arrange the discharging brush 145 on the rear of the recording paper 6, that is, on the opposite surface of the print surface.

Figure 17:
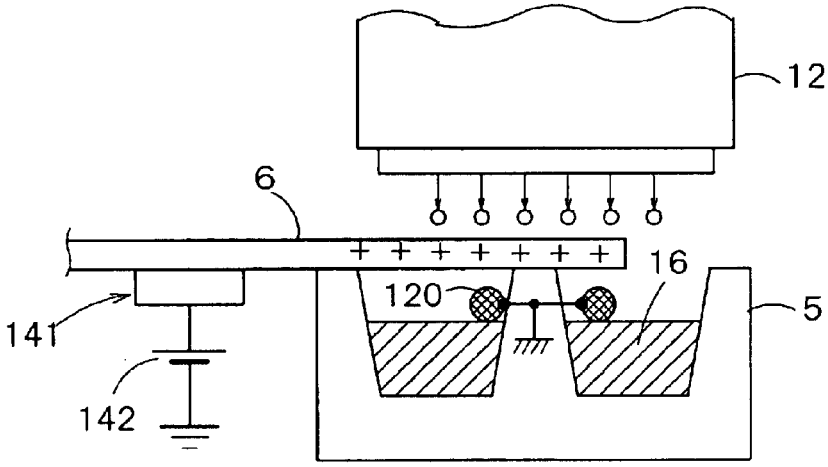
FIG. 17 is a sectional view showing another variation of the embodiment shown in FIGS. 11 and 12.

Further, as a further variation, as shown in FIG. 17, a voltage application unit 141 for applying a high voltage to the recording paper 6 and holding the recording paper 6 at a high potential may be installed. The voltage application unit 141 has a high voltage source 142.

According to this variation, for example, even in an environment that the recording paper 6 is humid, and the charge on the recording paper 6 is apt to be discharged, thus the potential of the recording paper 6 is not stabilized, the recording paper 6 can be stably held at a high potential by the voltage application unit 141, so that ink drops can be surely acquired by the electrostatic force.

Figure 18:
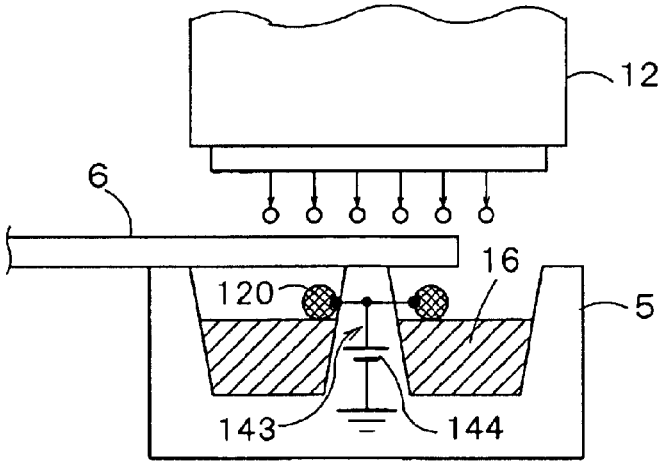
FIG. 18 is a sectional view showing still another variation of the embodiment shown in FIGS. 11 and 12.

Further, as a still further variation, as shown in FIG. 18, a voltage application unit 143 for applying a high voltage to the ink acquisition electrode 120 and holding the ink acquisition electrode 120 at a high potential may be installed. The voltage application unit 143 has a high voltage source 144.

According to this embodiment, even when the recording paper 6 is not charged, a potential difference is generated between the grounded mechanical frame and nozzle plate and the ink acquisition electrode 120 held at a high potential by the voltage application unit 143 and the electric field is centralized in the ink acquisition electrode 120, so that ink drops can be surely acquired by the electrostatic force.

Further, as yet a further variation, instead of constituting the ink acquisition electrode by a metallic wire, the absorption members 16 may be used as an acquisition electrode and by doing this, the same effect as that mentioned above can be produced. In this case, in the absorption members 16, a conductive material such carbon may be mixed and foamed in polyethylene or polyurethane so as to make the members conductive. Or, before execution of four-side edge-free printing, ink drops are ejected to the absorption members 16 by scanning the recording head 12 at a low speed free of scattering a mist and the absorption members 16 are moistened, thus the absorption members 16 can be given conductivity. As mentioned above, one end of each absorption member 16 as an ink acquisition electrode is grounded or electrically conducted to the high voltage source 144. According to this variation, a dedicated acquisition electrode such as a metallic wire is not required, so that the same effect as that mentioned above can be obtained by a lower-priced constitution.

Next, an ink jet recording apparatus as an embodiment of the liquid jet apparatus by the third aspect of the present invention will be explained with reference to the accompanying drawings.

The ink jet recording apparatus of this embodiment is common in the schematic constitution to the embodiment described in FIGS. 1 to 3, so that the parts intrinsic to this embodiment will be explained hereunder. Further, in this embodiment, the absorption members 16 (FIG. 3) can be formed by sponge and the like.

Next, the static electricity charging member and static electricity generation member of the ink jet recording apparatus of this embodiment will be explained by referring to FIG. 19.

Figure 19:
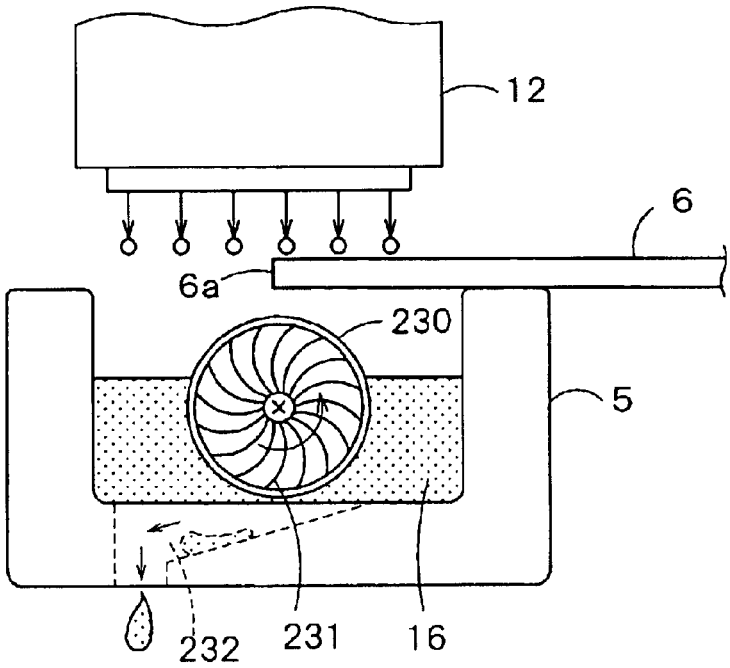
FIG. 19 is a sectional view showing the enlarged static electricity charged member and static electricity generation member and their circumference of an ink jet recording apparatus as an embodiment of the liquid jet apparatus by the third aspect of the present invention.

As shown in FIG. 19, a static electricity charging member 230 formed by a material easily charged with static electricity is extended and arranged in the head scanning direction in the area which is positioned on the rear side of the recording paper 6 during recording and opposite to the recording head 12. More concretely, the static electricity charging member 230 is partially embedded in the absorption member 16 installed on the platen 5 and the upper part of the static electricity charging member 230 is protruded from the surface of the absorption member 16 on the side of the recording head 12. The static electricity charging member 230 is composed of a plastic sheet of acrylic resin, polyester, or vinyl chloride which is formed in a tubular shape.

Inside the tubular static electricity charging member 230, a static electricity generation member 231 formed in a brush shape by a material easily generating static electricity is extended and arranged in the head scanning direction. The static electricity generation member 231 can rotate around the rotation shaft center parallel with the tubular axis of the static electricity charging member 230. The static electricity generation member 231 is formed by rayon, nylon, wool, or hair.

The static electricity generation member 231 is driven and rotated by the power from the paper feed motor 41 of the feed mechanism 40 of the recording apparatus, rubbed by dynamic contact with the inner peripheral surface of the static electricity charging member 230, thereby generates static electricity.

Further, in the bottom of the platen 5, an ink exhaust port 232 is formed and ink absorbed by the absorption member 16 is exhausted outside the platen 5.

And, according to this embodiment having the aforementioned constitution, the brush-shaped static electricity generation member 231 driven and rotated by the power from the paper feed motor 41 of the feed mechanism 40 is rubbed against the inner peripheral surface of the tubular static electricity charging member 230 and static electricity generated by it is charged on the static electricity charging member 230. Therefore, ink drops ejected into the area outside the recording paper 6 when so-called edge-free printing is executed for the recording paper 6 are attracted toward the static electricity charging member 230 by the static electricity charged on the static electricity charging member 230. The ink drops attracted on the side of the static electricity charging member 230 are attached to the surface of the static electricity charging member 230 and flow and drop on the absorption member 16 or are directly attached to the absorption member 16. Further, the top of the static electricity charging member 230 is curved, so that ink drops attached to it are apt to flow toward the absorption member 16.

As mentioned above, according to this embodiment, ink drops ejected into the area outside the edge 6*a* of the recording paper 6 are attracted by the static electricity charging member 230 and can be acquired by the absorption member 16, so that even when the recording paper 6 is to be printed free of a blank on the edge of the recording paper 6, an ink mist can be prevented from attaching to the rear edge of the recording paper 6 and the inside of the apparatus.

Further, since the ink exhaust port 232 is formed in the bottom of the platen 5, ink will neither overflow the platen 5 and the static electricity generation capacity will be nor reduced because the static electricity generation member 231 is soiled with ink.

Next, another embodiment of the present invention will be explained by referring to FIG. 20.

In the aforementioned embodiment, as shown in FIG. 19, the static electricity charging member 230 is formed in a tubular shape. In this embodiment, as shown in FIG. 20, the static electricity charging member 230 is formed by a sheet-like member curved convexly toward the recording head 12.

Further, the static electricity generation member 231 of this embodiment has the same constitution as that of the embodiment shown in FIG. 19, is arranged on the rear side of the static electricity charging member 230 as viewed from the position of the recording head 12, driven and rotated by the power from the paper feed motor 41 of the feed mechanism 40 of the recording apparatus, rubbed by dynamic contact with the rear of the static electricity charging member 230, thereby generates static electricity.

Also in this embodiment, in the same way as with the embodiment shown in FIG. 19, ink drops can be acquired by using the electrostatic force charged on the static electricity charging member 230. Further, as shown in FIG. 20, the static electricity charging member 230 is curved convexly toward the recording head 12, so that ink drops attached to the top of the static electricity charging member 230 are apt to flow toward the absorption member 16.

Figure 21:
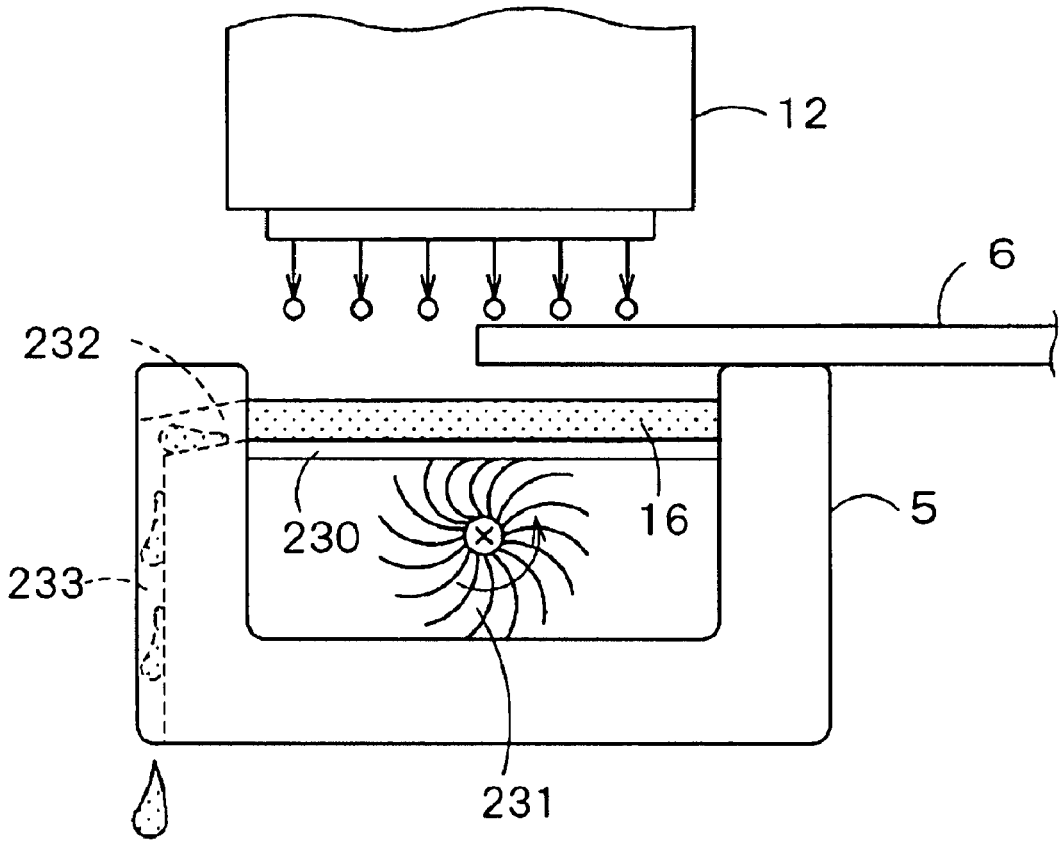
FIG. 21 is a sectional view showing the enlarged static electricity charged member and static electricity generation member and their circumference of an ink jet recording apparatus of still another embodiment of the liquid jet apparatus by the third aspect of the present invention.

Next, another embodiment of the present invention will be explained by referring to FIG. 21.

In the embodiment shown in FIG. 19, the static electricity charging member 230 is formed in a tubular shape. However, in this embodiment, as shown in FIG. 21, the static electricity charging member 230 is formed by a sheet-like member arranged in parallel with the nozzle forming surface of the recording head 12.

Further, the static electricity generation member 231 of this embodiment has the same constitution as that of the embodiment shown in FIG. 19, is arranged on the rear side of the static electricity charging member 230 as viewed from the position of the recording head 12, driven and rotated by the power from the paper feed motor 41 of the feed mechanism 40 of the recording apparatus, rubbed by dynamic contact with the rear of the static electricity charging member 230, thereby generates static electricity.

Furthermore, in this embodiment, the absorption member 16 is arranged on the recording head side of the static electricity charging member 230 and the absorption member 16 and the static electricity generation member 231 are completely separated from each other by the static electricity charging member 230.

The ink exhaust port 232 is formed in the side wall of the platen 5 so as to be interconnected to the arrangement space of the absorption member 16 and an ink exhaust groove 33 is continuously formed in the side of the platen 5 from the ink exhaust port 232.

Also in this embodiment, in the same way as with the embodiment shown in FIG. 19, ink drops can be acquired by using the electrostatic force charged on the static electricity charging member 230. Further, the absorption member 16 and the static electricity generation member 231 are completely separated from each other by the static electricity charging member 230, so that the static electricity generation member 231 can be prevented more surely from ink soil. Furthermore, the surface of the static electricity charging member 230 is covered with the absorption member 16, so that ink drops will not bounce and can be acquired more surely.

Next, still another embodiment of the present invention will be explained by referring to FIG. 22.

Figure 22:
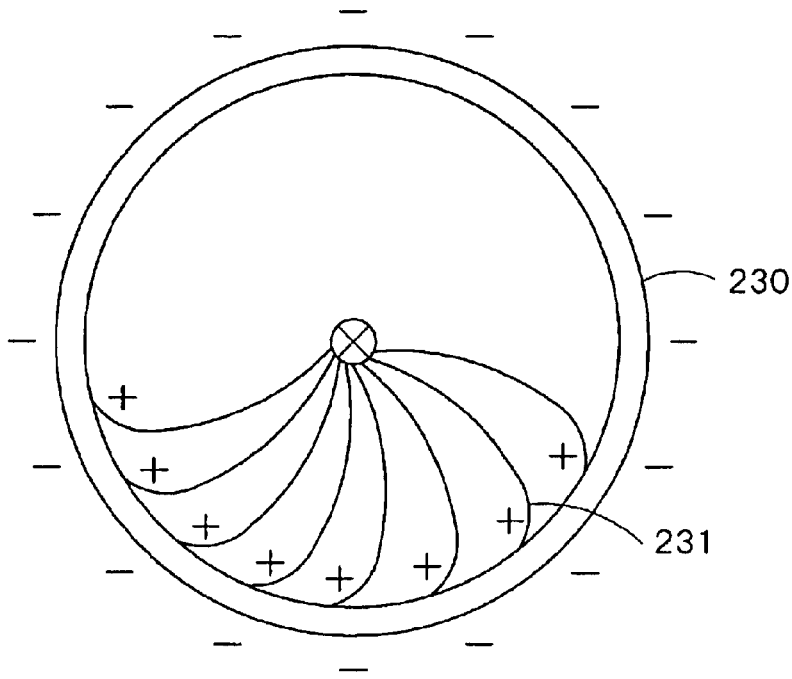
FIG. 22 is a sectional view showing the enlarged static electricity charged member and static electricity generation member and their circumference of an ink jet recording apparatus of a further embodiment of the liquid jet apparatus by the third aspect of the present invention.

This embodiment is changed in the constitution from the static electricity generation member 231 of the embodiment shown in FIG. 19 and as shown in FIG. 22, the brush constituting the static electricity generation member 231 has a sectional shape of a central angle of less than or equal to 180° around the revolving axis.

And, in this embodiment, the static electricity generation member 231 composed of a brush is positioned and stopped on a far side from the recording head 12 during recording and structured so as to rotate the static electricity generation member 231 during no recording so as to generate static electricity.

According to this embodiment having the aforementioned constitution, during recording, the static electricity generation member 231 positively charged is positioned on a far side from the recording head 12, so that the negative charge on the part of the static electricity charging member 230 on the side of the recording head 12 will not be neutralized by the positive charge of the static electricity generation member 231. Therefore, when the static electricity charging member 230 is viewed from the side of the recording head 12, the apparent charge of the static electricity charging member 230 will not be reduced and an ink mist can be surely acquired over a wide range by the lines of electric force emitted from the static electricity charging member 230.

Figure 23:
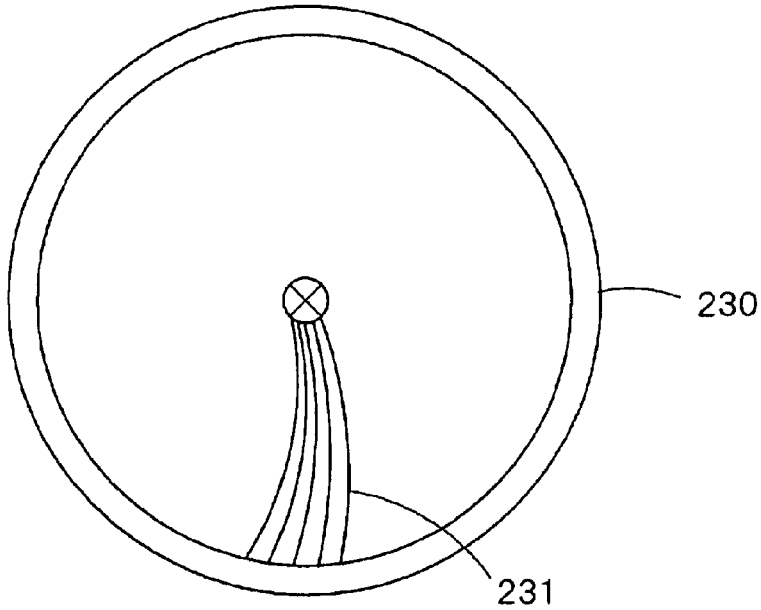
FIG. 23 is a sectional view showing the enlarged static electricity charged member and static electricity generation member and their circumference of an ink jet recording apparatus of a variation of the embodiment shown in FIG. 22.

Further, as a variation of the embodiment shown in FIG. 22, as shown in FIG. 23, the static electricity generation member 231 may be composed of a brush having a section of almost a straight line. Also in this variation, the same effect as that of the embodiment shown in FIG. 22 can be obtained.

Next, a further embodiment of the present invention will be explained by referring to FIG. 24.

Figure 20:
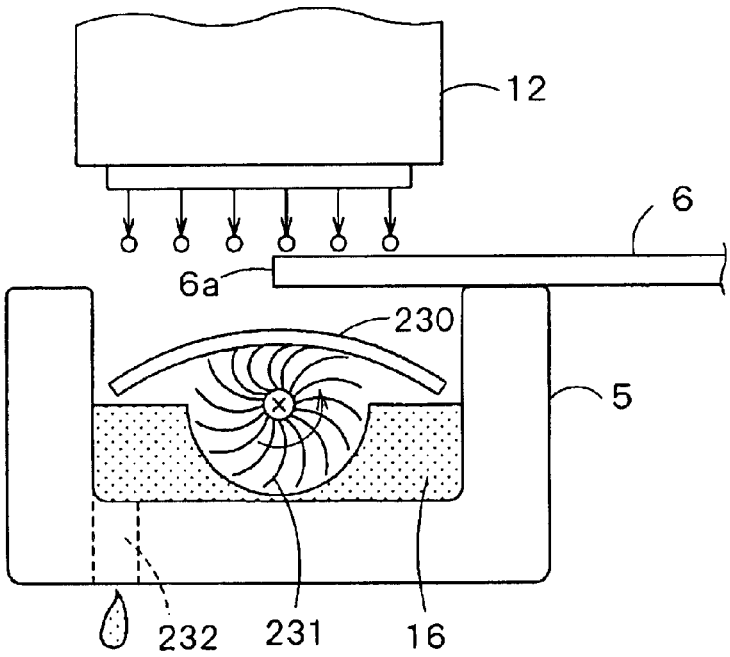
FIG. 20 is a sectional view showing the enlarged static electricity charged member and static electricity generation member and their circumference of an ink jet recording apparatus of another embodiment of the liquid jet apparatus by the third aspect of the present invention.
Figure 24:
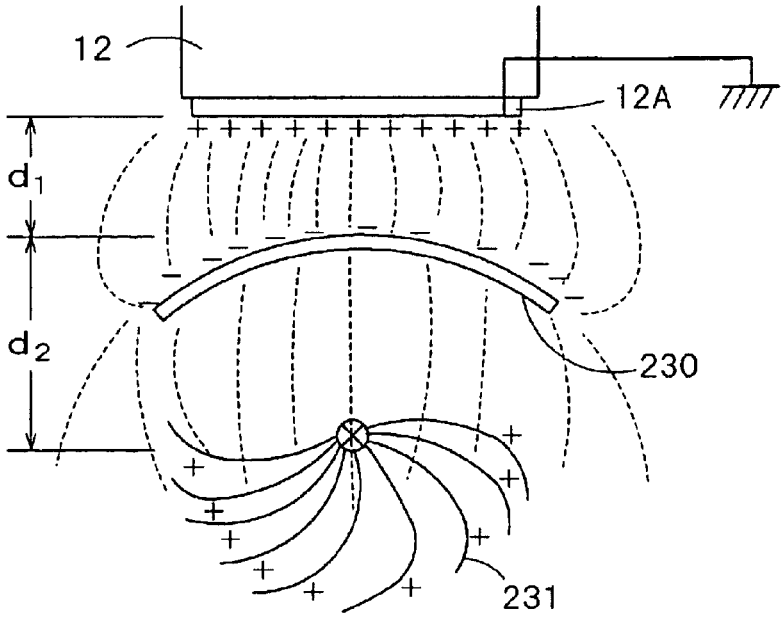
FIG. 24 is a sectional view showing the enlarged static electricity charged member and static electricity generation member and their circumference of an ink jet recording apparatus of a still further embodiment of the liquid jet apparatus by the third aspect of the present invention.

This embodiment is changed in the constitution from the static electricity generation member 231 of the embodiment shown in FIG. 20 and as shown in FIG. 24, the brush constituting the static electricity generation member 231 has a sectional shape of a central angle of less than or equal to 180° around the rotational shaft center.

Further, in this embodiment, the nozzle plate 12A of the recording head 12 having the nozzle openings 12*a* (FIG. 3) is electrically grounded.

And, in this embodiment, the static electricity generation member 231 composed of a brush is positioned on a far side from the recording head 12 during recording, stopped in a non-contact state with the static electricity charging member 230, and structured so as to rotate the static electricity generation member 231 during no recording so as to generate static electricity.

Furthermore, in this embodiment, during recording (the static electricity generation member 231 is stopped), the distance d2 from the static electricity charging member 230 to the static electricity generation member 231 is longer than the distance d1 from the static electricity charging member 230 to the nozzle forming surface of the nozzle plate 12A.

According to this embodiment having the aforementioned constitution, during recording, the static electricity generation member 231 positively charged is positioned on a far side from the recording head 12 in a non-contact state with the static electricity charging member 230 and furthermore the distance d2 from the static electricity charging member 230 to the static electricity generation member 231 is longer than the distance d1 from the static electricity charging member 230 to the nozzle forming surface of the nozzle plate 12A, so that the density of the lines of electric force formed between the static electricity charging member 230 and the nozzle plate 12A is increased and an ink mist can be acquired surely over a wide range.

Figure 25:
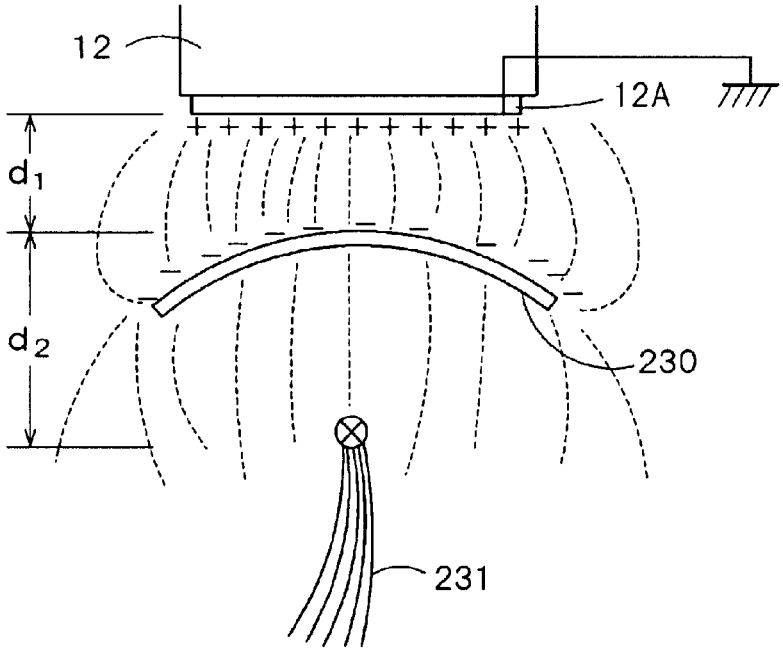
FIG. 25 is a sectional view showing the enlarged static electricity charged member and static electricity generation member and their circumference of an ink jet recording apparatus of a variation of the embodiment shown in FIG. 24.

Further, as a variation of the embodiment shown in FIG. 24, as shown in FIG. 25, the static electricity generation member 231 may be composed of a brush having a section of almost a straight line. Also in this variation, the same effect as that of the embodiment shown in FIG. 24 can be obtained.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A liquid jet apparatus comprising:

a liquid jet head having a nozzle plate with a nozzle opening, said liquid jet head being configured to eject liquid drops from said nozzle opening by changing pressure of liquid in a pressure chamber interconnecting to said nozzle opening, a scanning mechanism configured to scan said liquid jet head in a head scanning direction, a feed mechanism configured to feed an object to be processed, to which liquid drops ejected from said liquid jet head are applied, in a feed direction perpendicular to said head scanning direction, an absorption member arranged in an area, which is on a rear side of said object to be processed under processing and opposite to said liquid jet head, and configured to absorb liquid drops ejected into an area outside said object to be processed, and a potential difference generation unit configured to generate a potential difference between at least one of said absorption member and a member neighboring said absorption member and said nozzle plate.

2. A liquid jet apparatus according to claim 1, wherein said potential difference generation unit applies a voltage to at least one of said absorption member and said member neighboring said absorption member and grounds said nozzle plate.

3. A liquid jet apparatus according to claim 1, wherein said potential difference generation unit grounds at least one of said absorption member and said member neighboring said absorption member and applies a voltage to said nozzle plate.

4. A liquid jet apparatus according to claim 1, wherein said member neighboring said absorption member has a conductive part extended in said head scanning direction and a conductive part extended in said feed direction.

5. A liquid jet apparatus according to claim 4, wherein said member neighboring said absorption member is formed in a lattice shape.

6. A liquid jet apparatus according to any one of claims 1 to 5, wherein said absorption member includes a conductive material.

7. A liquid jet apparatus according to claim 6, wherein said absorption member is formed by mixing a conductive material in polyethylene or polyurethane and foaming the same.

8. A liquid jet apparatus according to claim 6, wherein said absorption member is formed by plating a foam material of polyethylene or polyurethane with a conductive material.

9. A liquid jet apparatus according to claim 6, wherein said absorption member contains an electrolytic liquid.

10. A liquid jet apparatus according to claim 9, wherein said electrolytic liquid is a liquid ejected from said liquid jet head.

11. A liquid jet apparatus according to claim 1, further comprising a holding unit configured to hold said object to be processed under processing in an electrically isolated state.

12. A liquid jet apparatus according to claim 11, wherein said holding unit has an insulating material installed at least on a surface of each member making contact with said object to be processed under processing.

13. A liquid jet apparatus according to claim 1, further comprising:

a platen arranged opposite to said liquid jet head so as to support said object to be processed, which is fed by said feed mechanism, from a rear of said object and position said object to be processed with respect to said liquid jet head, wherein said absorption member is installed in said platen.

14. A liquid jet apparatus according to claim 1, wherein said absorption member is mounted in a stationary state.

15. A liquid jet apparatus comprising:

a liquid jet head configured to eject liquid drops from a nozzle opening by changing pressure of liquid in a pressure chamber interconnecting to said nozzle opening, a scanning mechanism configured to scan said liquid jet head in a head scanning direction, a feed mechanism configured to feed an object to be processed, to which liquid drops ejected from said liquid jet head are given, in a feed direction perpendicular to said head scanning direction, and a liquid drop acquisition electrode arranged in an area, which is on a rear side of said object to be processed under processing and opposite to said liquid jet head, and configured to acquire liquid drops ejected into an area outside an edge of said object to be processed by electrostatic force.

16. A liquid jet apparatus according to claim 15, further comprising:

a platen arranged opposite to said liquid jet head so as to support said object to be processed, which is fed by said feed mechanism, from a rear of said object and position said object to be processed with respect to said liquid jet head, said platen having an absorption member configured to absorb liquid drops ejected from said liquid jet head, wherein said liquid drop acquisition electrode is arranged in a neighborhood of said absorption member.

17. A liquid jet apparatus according to claim 15, wherein said liquid drop acquisition electrode has a part extended in said head scanning direction and a part extended in said feed direction.

18. A liquid jet apparatus according to claim 15, wherein said liquid drop acquisition electrode is composed of a metallic wire member.

19. A liquid jet apparatus according to claim 15, wherein said liquid drop acquisition electrode is composed of a long and narrow metallic member having a triangular section.

20. A liquid jet apparatus according to claim 15, wherein said liquid drop acquisition electrode is composed of a metallic needle member.

21. A liquid jet apparatus according to claim 15, wherein a surface of said liquid drop acquisition electrode is treated with an insulation.

22. A liquid jet apparatus according to claim 15, wherein a surface of said liquid drop acquisition electrode is treated with a corrosion preventive.

23. A liquid jet apparatus according to claim 15, further comprising:

a platen arranged opposite to said liquid jet head so as to support said object to be processed, which is fed by said feed mechanism, from a rear of said object and position said object to be processed with respect to said liquid jet head, said platen having an absorption member configured to absorb liquid drops ejected from said liquid jet head, wherein said absorption member is said liquid drop acquisition electrode.

24. A liquid jet apparatus according to claim 15, further comprising: a charging unit configured to charge said object to be processed.

25. A liquid jet apparatus according to claim 24, wherein said charging unit has a corona discharger or a charging brush.

26. A liquid jet apparatus according to claim 24, wherein said feed mechanism has a roller configured to feed said object to be processed onto said platen, and wherein said charging unit has a roller cleaner for cleaning a surface of said roller.

27. A liquid jet apparatus according to claim 15, further comprising: a voltage application unit configured to apply a high voltage to said object to be processed and hold said object to be processed at a high potential.

28. A liquid jet apparatus according to claim 15, wherein said liquid drop acquisition electrode is grounded.

29. A liquid jet apparatus according to claim 15, further comprising: a voltage application unit configured to apply a high voltage to said liquid drop acquisition electrode and hold said liquid drop acquisition electrode at a high potential.

30. A liquid jet apparatus according to claim 15, further comprising a discharging unit configured to discharge static electricity from said object to be processed and installed on a downstream side of said liquid jet head in said feed direction.

31. A liquid jet apparatus according to claim 30, wherein said discharging unit has a discharging brush.

32. A liquid jet apparatus according to claim 31, wherein said discharging brush is in contact with a rear of said object to be processed.

33. A liquid jet apparatus according to claim 15, wherein said absorption member is mounted in a stationary state.

34. A liquid jet apparatus comprising:

a liquid jet head configured to eject liquid drops from a nozzle opening by changing pressure of liquid in a pressure chamber interconnecting to said nozzle opening, a scanning mechanism configured to scan said liquid jet head in a head scanning direction, a feed mechanism configured to feed an object to be processed, to which liquid drops ejected from said liquid jet head are given, in a feed direction perpendicular to said head scanning direction, a static electricity charging member arranged in an area which is on a rear side of said object to be processed under processing and opposite to said liquid jet head, and a static electricity generation member configured to generate static electricity by dynamically making contact with said static electricity charging member.

35. A liquid jet apparatus according to claim 34, further comprising:

a platen arranged opposite to said liquid jet head so as to support said object to be processed, which is fed by said feed mechanism, from a rear of said object and position said object to be processed with respect to said liquid jet head, said platen having an absorption member configured to absorb liquid drops ejected from said liquid jet head, wherein at least a part of said static electricity charging member is arranged in the neighborhood of said absorption member.

36. A liquid jet apparatus according to claim 35, wherein said platen has a liquid exhaust port.

37. A liquid jet apparatus according to claim 35, wherein said platen has a liquid exhaust groove.

38. A liquid jet apparatus according to claim 35, wherein said static electricity charging member is formed by a sheet-like member, wherein said absorption member is arranged on a liquid jet head side of said static electricity charging member, and said static electricity generation member is arranged on a rear side of said static electricity charging member viewed from said liquid jet head.

39. A liquid jet apparatus according to claim 38, wherein said static electricity generation member has a rotatable brush configured to dynamically make contact by rotation with a rear of said static electricity charging member composed of said sheet-like member, and wherein said brush has a sectional shape of a central angle of less than or equal to 180° around said revolving axis.

40. A liquid jet apparatus according to claim 39, wherein said brush is positioned on a far side from said liquid jet head during a liquid jetting operation and stopped in a non-contact state with said static electricity charging member, and said brush is rotated when said liquid jetting operation is not performed.

41. A liquid jet apparatus according to claim 34, wherein said static electricity charging member is formed in a tubular shape, and wherein said static electricity generation member is arranged inside said static electricity charging member and driven and rotated around a revolving axis parallel with a tubular axis of the static electricity charging member.

42. A liquid jet apparatus according to claim 41, wherein said static electricity generation member has a rotatable brush configured to dynamically make contact with an inner peripheral surface of said tubular static electricity charging member, and wherein said brush has a sectional shape of a central angle of less than or equal to 180° around said revolving axis.

43. A liquid jet apparatus according to claim 42, wherein said brush is positioned and stopped on a far side from said liquid jet head during a liquid jetting operation and is rotated when said liquid jetting operation is not performed.

44. A liquid jet apparatus according to claim 34, wherein said static electricity charging member is formed by a sheet-like member curved convexly toward said liquid jet head, and wherein said static electricity generation member is arranged on a rear side of said static electricity charging member viewed from a position of said liquid jet head.

45. A liquid jet apparatus according to claim 44, wherein said static electricity generation member has a rotatable brush configured to dynamically make contact by rotation with a rear of said static electricity charging member composed of said sheet-like member, and wherein said brush has a sectional shape of a central angle of less than or equal to 180° around said revolving axis.

46. A liquid jet apparatus according to claim 45, wherein said brush is positioned on a far side from said liquid jet head during a liquid jetting operation and stopped in a non-contact state with said static electricity charging member and is rotated when said liquid jetting operation is not performed.

47. A liquid jet apparatus according to claim 34, wherein said static electricity generation member is positioned and stopped on a far side from said liquid jet head during a liquid jetting operation, and said static electricity generation member dynamically makes contact with said static electricity charging member when said liquid jetting operation is not performed.

48. A liquid jet apparatus according to claim 47, wherein during said liquid jetting operation, said static electricity generation member is in a non-contact state with said static electricity charging member.

49. A liquid jet apparatus according to claim 48, wherein during said liquid jetting operation, a distance from said static electricity charging member to said static electricity generation member is longer than a distance from said static electricity charging member to a nozzle forming surface of said liquid jet head.

50. A liquid jet apparatus according to claim 34, wherein said static electricity charging member and said static electricity generation member are extended in said head scanning direction.

51. A liquid jet apparatus according to claim 34, wherein said static electricity charging member has a plastic sheet.

52. A liquid jet apparatus according to claim 34, wherein said static electricity generation member has a brush.

53. A liquid jet apparatus according claim 34, wherein said static electricity generation member is driven by power of said feed mechanism.

54. A liquid jet apparatus according to claim 34, wherein said liquid jet head has a nozzle plate in which said nozzle opening is formed and said nozzle plate is electrically grounded.

* * * * *